US005203313A

United States Patent [19]

Rotarius

[11] Patent Number: 5,203,313

[45] Date of Patent: Apr. 20, 1993

[54] EGR VENTURI COUPLER

[75] Inventor: Timothy F. Rotarius, New Baltimore, Mich.

[73] Assignee: Bundy Corporation, Warren, Mich.

[21] Appl. No.: 901,491

[22] Filed: Jun. 19, 1992

[51] Int. Cl.[5] ..... F02M 25/06

[52] U.S. Cl. ..... 123/571; 123/568

[58] Field of Search ..... 123/571, 568

[56] References Cited

U.S. PATENT DOCUMENTS

| | | | |
|---|---|---|---|
| 4,094,284 | 6/1978 | Gesell | 123/568 |
| 4,690,120 | 9/1987 | Egle | 123/571 |
| 4,770,146 | 9/1988 | Shibata et al. | 123/571 |
| 4,881,509 | 11/1989 | Ohashi et al. | 123/571 |
| 4,895,125 | 1/1990 | Geiger | 123/568 |

*Primary Examiner*—David A. Okonsky
*Assistant Examiner*—M. Macy
*Attorney, Agent, or Firm*—Barnes, Kisselle, Raisch, Choate, Whittemore & Hulbert

[57] ABSTRACT

An engine exhaust gas recirculation system with a venturi with pressure taps on both sides for indicating and controlling the rate of flow of recirculated exhaust gas. Through an electronic control unit the pressure drop across the venturi is used to control the extent to which a recirculation valve is opened and hence control the flow rate of recirculated gas in response to engine operating conditions. Preferably, the venturi has a frustoconical entrance and a cylindrical throat.

15 Claims, 2 Drawing Sheets

EGR VENTURI COUPLER

FIELD OF THE INVENTION

This invention relates generally to an exhaust gas recirculation (EGR) system for an automotive-type engine for returning part of the exhaust gas of the engine to the intake manifold. More particularly, the invention relates to an EGR system with a venturi having a specific configuration that functions as a flow meter to control EGR flow.

BACKGROUND OF THE INVENTION

An EGR system, as is known, recirculates part of the exhaust gas back to the intake of an engine for reducing harmful nitrous oxide emissions. Fuel consumption and engine performance are affected by the recirculated exhaust gas flow. For example, engine performance may be affected by the temperature of the exhaust gas which is higher than that of the fresh air-fuel mixture introduced into the combustion chamber. The "hot" exhaust gas acts to heat up the combustible mixture thus facilitating the combustibility of the air-fuel mixture. As is known, the amount of exhaust gas returned is controlled by an EGR valve that is opened and closed by a control unit depending on operating conditions of the engine. To minimize exhaust gas emissions, it is important to accurately control the amount of exhaust gas recirculated according to engine operating conditions, such as, engine speed, temperature, inlet and exhaust gas pressure and temperature and atmospheric temperature, pressure and moisture conditions. Typically, with a cold start of the engine the EGR valve is initially closed to prevent recirculation, opened immediately after starting to recirculate exhaust gas to more quickly heat the engine and promote more complete combustion of fuel, and then closed when the engine warms up to operating temperature.

Some prior EGR systems have used a sharp edged orifice to limit the maximum flow rate of the recirculated exhaust gas and to provide a single pressure tap upstream of the orifice for a signal used by an engine control processor to indicate when the EGR valve is open. In practice, sharp edge orifices with the same nominal dimensions could not be mass produced with the same flow rate for the same pressure drop and produced significant variations in flow rate and pressure drop from one orifice to another.

SUMMARY OF THE INVENTION

An EGR system for an internal combustion engine with a variable and controlled rate of flow of recirculated exhaust gas. The recirculation flow rate is sensed by a venturi with pressure taps on both sides which through a transducer produces a signal used by an engine control unit to vary the extent to which a recirculation valve is opened to achieve the desired rate of flow or quantity of exhaust gas recirculated by the system. The control unit determines the desired flow rate, compares it with the actual flow rate sensed by the venturi and adjusts the recirculation valve to achieve the desired flow rate which varies under different engine load and operating conditions.

The flow rate through the venturi varies with the differential pressure drop across the venturi. Mass production venturis of the same nominal size have essentially the same differential pressure drop for the same flow rate. This is achieved by a venturi with a frustoconical entrance having a substantially planar wall and a cylindrical throat. The specific dimensions and configuration of the venturi provide a controlled flow rate proportional to the differential pressure drop over a wide range of operating conditions.

Objects, features and advantages of this invention are to provide an EGR system with a control venturi which readily varies and accurately controls the rate of flow of recirculated exhaust gas, is of relatively simple design, improves fuel economy, complies with Federal emissions standards, and is regugged, durable, economical to manufacture and assemble, easy to calibrate, compensates for deposits in the recirculation system due to extended use, has a long in-service useful life and requires virtually no maintenance or service in use.

BRIEF DESCRIPTION OF THE DRAWINGS

These and other objects, features and advantages of this invention will be apparent from the following detailed description, appended claims and accompanying drawings in which:

DETAILED DESCRIPTION OF THE PREFERRED EMBODIMENT

Figure 1:
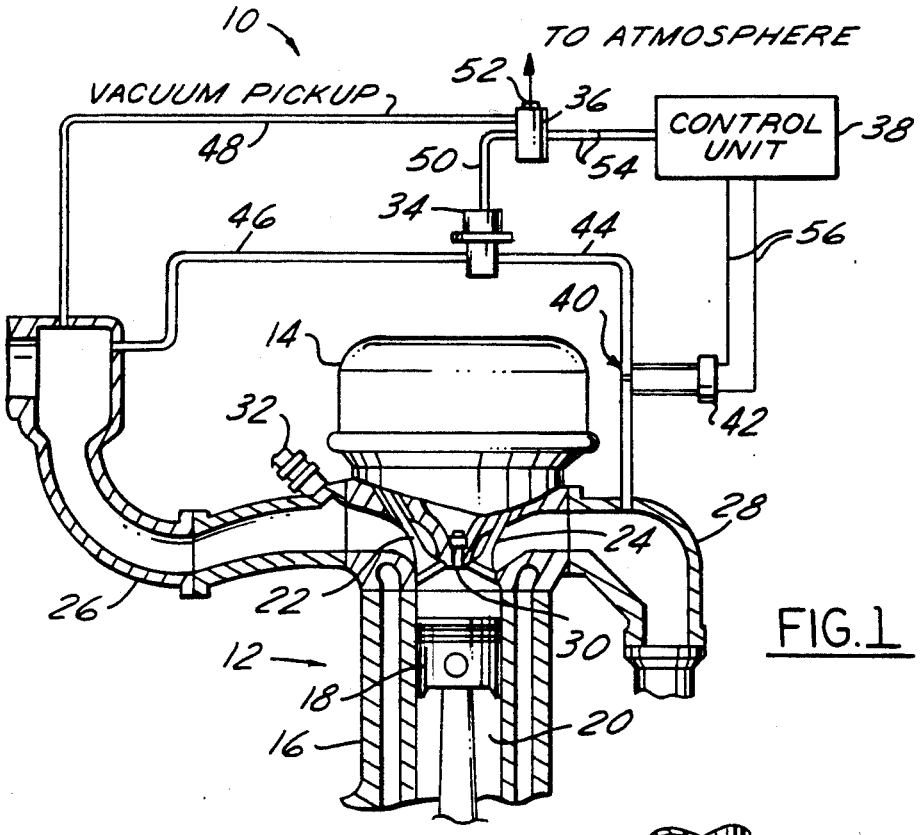
FIG. 1 is a schematic diagram of an EGR system embodiment this invention.

FIG. 1 illustrates an exhaust gas recirculation (EGR) system 10 for an internal combustion engine 12. The engine may be of conventional construction with a head 14 secured to a block 16 having pistons 18 slideably received in cylinders 20 with intake and exhaust valves 22 and 24 for each cylinder. Combustion air is supplied to the cylinders 20 from an intake manifold 26 and exhaust gases pass through an exhaust manifold 28. The engine fuel or gasoline is ignited by a spark plug 30 in each cylinder. Typically, fuel is supplied to the engine through a fuel injector 32 or a carburetor mounted on the intake manifold. As the engine may be of conventional construction, it will not be described in further detail.

The EGR system 10 has a vacuum actuated gas recirculation valve 34 operated by an electonically controlled vacuum regulator (EVR) 36 which is cycled and controlled by a central processor control unit 38. The rate of flow of recirculated gas through the valve 34 and into the engine is sensed by a venturi assembly 40 connected to a transducer 42, such as a ceramic capacitance differential pressure sensor, which provides to the processor unit 38 an electric signal indicative of the flow rate of the recirculated gas. The control unit 38 compares the desired flow rate of the recirculated gas with the actual flow rate and opens, closes or varies the extent of the opening of the recirculation valve 34 to achieve the desired flow rate. The control unit 38 determines the desired flow rate, if any, of the recirculation gas, compares the desired rate to the actual rate indicated by the venturi assembly 40 and transducer 42, and generates a signal to vary and adjust through the vacuum regulator 36 the extent of opening of the recirculation valve 34 to achieve the desired flow rate of the recirculated gas.

To recirculate exhaust gases, the inlet of the recirculation valve 34 is connected to the exhaust manifold 28 through the venturi assembly 40 by a conduit 44. The outlet of the recirculation valve is connected to the engine intake manifold 26 by a conduit 46. The inlet of the regulator 36 is connected to a source of vacuum, such as the intake manifold 26, by a conduit 48, and the outlet is connected to a vacuum supply port of the recirculation valve 34 by a conduit 50. The vacuum regulator varies and controls the extent of the vacuum applied to an actuator diaphragm of the recirculation valve by bleeding air from the atmosphere through a port 52 controlled by an electric solenoid (not shown). The solenoid of the vacuum regulator 36 is electrically connected to the control unit by electric wires or a cable 54, and the transducer 42 is electrically connected to the control unit by electric wires or a cable 56.

Figure 2:
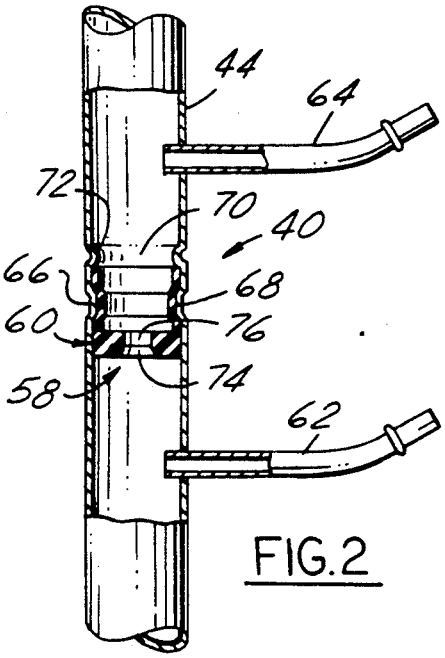
FIG. 2 is a fragmentary side view with portions broken away and in section of a first embodiment of the venturi of this invention.

In accordance with this invention, to both accurately vary the flow rate of the recirculated gas and provide an indication of this flow rate, as shown in FIG. 2, the venturi assembly 40 has a venturi 58 in a cylindrical body 60 with pressure taps 62 and 64 on both sides thereof. The pressure taps are connected to the transducer 42 which produces an electric signal indicative of and varying with the differential pressure drop across the venturi and hence the flow rate of recirculated gas through the venturi and into the intake manifold 26. Preferably, the body 60 is retained and sealed in the tube by circumferentially continuously crimping the tube at 66 into firm engagement with a groove 68 in a tubular side wall 70 of the body. Preferably, a plurality of circumferentially spaced indentations 72 in the tube 44 locate the body therein before it is crimped and sealed to the tube.

In accordance with this invention, to provide a venturi in which the differential pressure drop across the taps varies significantly with changes in flow rate and which can be mass produced with the same performance characteristics from one venturi to another with the same nominal size and configuration, the venturi 58 has a frusto-conical entrance 74 and a cylindrical throat 76. Preferably, the side wall of the entrance 74 is flat or planar and the entrance has a minimum axial depth or length of at least 0.020 of an inch and desirably the depth is in the range of 0.025 to 0.055 of an inch and preferably 0.025 to 0.045 of an inch. Preferably, the throat has a minimum axial depth or length of at least 0.020 of an inch and is desirably in the range of about 0.020 to 0.125 of an inch and is preferably about 0.055 to 0.115 of an inch. While the axial length of the throat can be increased, doing so tends to increase the deposit or build up of exhaust contaminants on the venturi during long term in-service use. Since these deposits may have a detrimental affect on performance of the venturi, it is believed to be preferable for the maximum axial length of the throat to be not substantially greater than 0.125 of an inch.

The diameter of the throat depends on the desired maximum flow rate through the orifice. For a maximum flow rate of 12 standard cubic feet per minute with a pressure drop of 120 inches of water, the diameter of the throat is about 0.236 of an inch.

Figure 4:
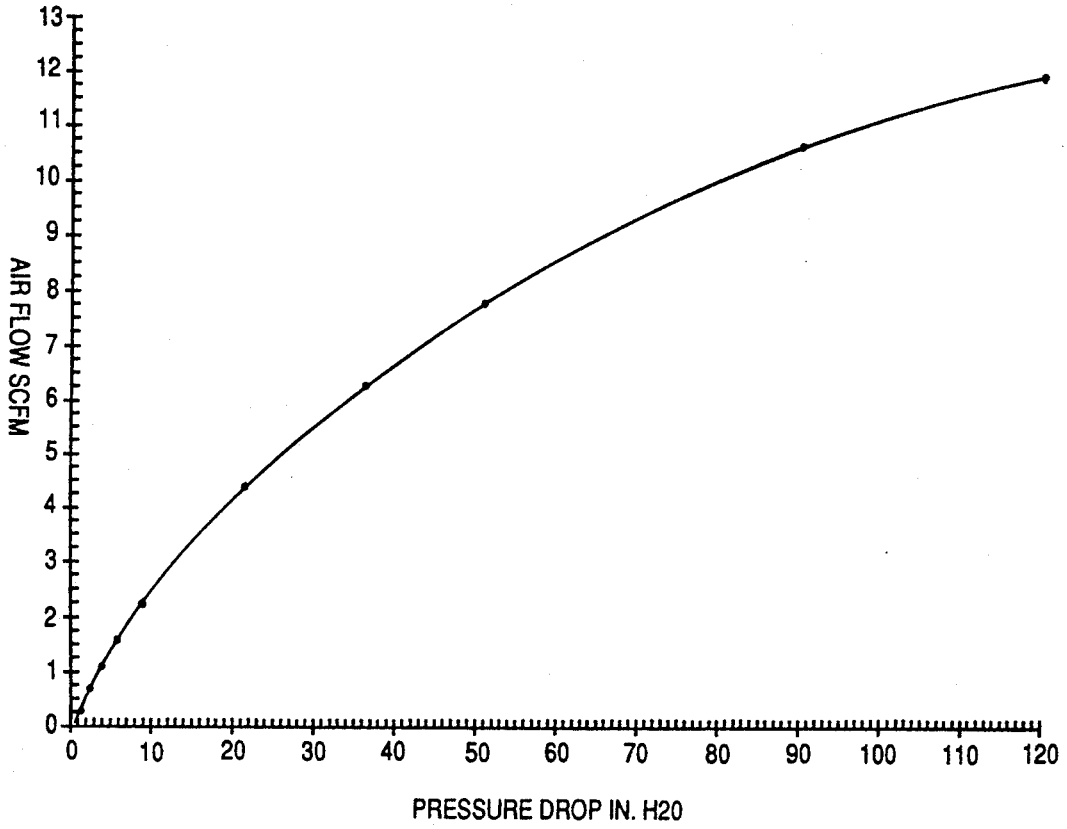
FIG. 4 is a graph showing flow rate vs. differential pressure drop of a venturi of an embodiment of this invention.

As indicated in FIG. 4, this configuration of the venturi produces a differential pressure drop across the taps 62 and 64 which is proportional to the flow rate through the venturi and varies significantly with changes in the flow rate across substantially the entire range of the flow rate from minimum flow to maximum flow. This change in differential pressure drop in proportion to the flow rate produces an output signal providing an accurate indication of the flow rate and which varies significantly for a relatively small change in the flow rate thereby providing a highly desirable output signal for accurately determining and controlling the flow rate or quantity of recirculated gas supplied to the engine intake manifold by the system 10.

Figure 3:
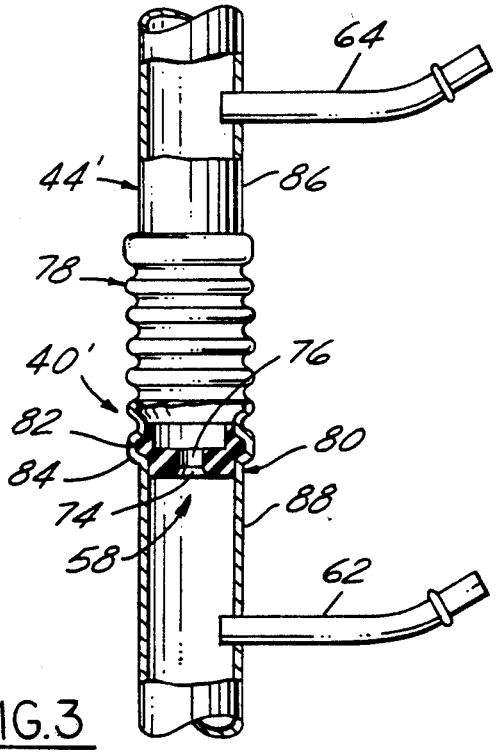
FIG. 3 is a fragmentary side view with portions broken away and in section of a second embodiment of the venturi of this invention.

FIG. 3 illustrates a slightly modified venturi assembly 40' received in a conduit 44' having a bellows 78 therein to accommodate slight bending or twisting of the tube 44' during installation and expansion and contraction thereof due to temperature changes. The venturi assembly has a generally cylindrical body 80 with an outer peripheral and circumferentially continuous rib 82 received and sealed in a convolution 84 of the bellows. To facilitate manufacture and assembly preferably the tube 44' is formed in two portions 86 and 88 which are brazed or otherwise attached and sealed together adjacent the free end of the bellows which is preferably formed integrally with the tube portion 88. If desired, both the convolutions 84 of the bellows and the rib 82 of the venturi body can be formed with the same pitch or spiral so that the venturi body 80 can be threaded into the bellows portion of the tube. If desired, the body can be brazed, welded, crimped or otherwise secured in the convolution of the tube to permanently fix the body therein and provide a gas tight seal between them.

In use of the system 10, the recirculation control valve 30 is opened and closed in response to engine operating conditions by the central processing control unit 38 which frequently is a part of an electronic engine control module. Typically, while a cold engine is being started, the control unit closes the recirculation valve 34 so that no exhaust gas is recirculated to the intake manifold 26. Once the engine starts, the control unit opens the valve 34 to recirculate a portion of the hot exhaust gases through the intake manifold to more rapidly vaporize the fuel and heat the engine to its normal operating temperature. When the engine reaches a predetermined elevated temperature, the control unit may fully close the valve 34 and stop further recirculation of exhaust gas.

Normally, while exhaust gas is being recirculated, the extent to which the valve 34 is open, is adjusted and varied to provide the desired flow rate or quantity of recirculated exhaust gas determined by the control unit 40 in response to varying engine operating loads, working conditions and intake manifold air or atmospheric conditions. To control the extent to which the recirculation valve 34 is open, preferably a variable duty cycle current is applied to the solenoid of the vacuum regulator 36 by the control unit 38. When the recirculation valve 34 is closed, the regulator 36 vents most of the vacuum from its source to the atmosphere and when the valve 34 is fully open, the regulator vents a significantly smaller portion of the vacuum and transmits a greater vacuum to an actuating diaphragm of the recirculation valve 38. For example, if the control unit applied a 0% duty cycle to the vacuum regulator 36, it transmits only about 0.07 of an inch of Hg of vacuum to the control diaphragm of the recirculation valve 34 and it remains closed. On the other hand, if the control unit applied a 100% duty cycle to the regulator, then it transmits a vacuum of about 5.5 inches of Hg to the diaphragm of the valve 34 to actuate it to its fully open position. At any intermediate duty cycle applied by the controller to the regulator, an intermediate vacuum level will be applied to the valve and it will be only partially open to regulate and control the flow rate of exhaust gas to the engine intake manifold.

As previously indicated, the control unit determines the desired recirculation gas flow rate, compares it to the actual flow rate sensed by the venturi assembly 40 or 40' and transducer 42 and varies the duty cycle to modulate the recirculation valve 34 to change the actual flow rate to the desired flow rate determined by the control unit 38. Since the actual pressure differential is continuously monitored, compared and adjusted to the desired differential pressure and hence the desired recirculation gas flow rate, this system provides a feed-back loop which maintains the actual flow rate of the recirculated gas at substantially the desired flow rate for the then present engine operating conditions.

This system with a venturi assembly continuously measuring the flow rate of recirculated gas provides more accurate and response control of exhaust gas flow. The control unit is thus better able to more accurately and rapidly determine the actual flow rate, compare it with the desired flow rate, and make proper adjustments resulting in a smoother and more efficient engine operation and a substantial reduction of exhaust gas emissions under actual operating conditions of the engine.

What is claimed is:

1. An exhaust gas recirculation system for an internal combustion engine comprising:

a conduit with an exhaust inlet and an exhaust outlet;

a venturi located within said conduit through which exhaust gases flow;

pressure taps located on each side of said venturi for indicating the pressure on each side thereof;

a transducer connected to said pressure taps for sensing the pressure differential across said venturi and producing an electric output signal indicative thereof;

a valve disposed in said conduit and operable to closed, open and partially open positions to control the rate of flow of exhaust gases through said conduit from said inlet through said outlet for recirculating the exhasut gases through an internal combustion engine; and an electronic control unit operably connected to said transducer for receiving the output signal thereform and to said valve for varying the extent to which said valve is open to control the rate of flow of recirculating exhaust gases in response to varying engine operating conditions, whereby said valve is controlled by said control unit as a function of the pressure differential across said venturi such that said valve controls recirculating exhasut gas flow through the engine.

2. The system of claim 1 wherein said venturi comprises a body with an opening therethrough defined by a frusto-conical entrance and a cylindrical throat.

3. The system of claim 2 wherein the frusto-conical entrance has an axial depth of at least 0.020 of an inch.

4. The system of claim 2 wherein the frusto-conical entrance has an axial depth of about 0.025 to 0.055 of an inch.

5. The system of claim 3 wherein the frusto-conical entrance has a substantially planar wall.

6. The system of claim 3 wherein the throat has an axial depth of at least 0.020 of an inch.

7. The system of claim 3 wherein the throat has an axial depth of at least 0.055 of an inch.

8. A venturi coupler of an engine exhaust gas recirculation system comprising:

a tubular coupler having ends adapted to be connected between an intake and an exhaust of an internal combustion engine for receiving exhasut gases flowing from the exhaust;

a venturi within said coupler through which exhaust gases flow;

said venturi comprising a body with an opening therethrough defined by a frost-conical entrance having an axial depth of about 0.020 to 0.055 of an inch and a cylindrical throat having an axial depth of at least 0.020 of an inch; and pressure taps on each side of said venturi for indicating pressure on each side of said venturi.

9. The venturi coupler of claim 8 wherein the frusto-conical entrance has a substantially planar wall.

10. The venturi coupler of claim 8 wherein said throat has an axial depth of at least 0.055 of an inch.

11. The venturi coupler of claim 8 further comprising said body having a cylindrical wall;

said wall having a free end;

locator means on said coupler, said free end of said wall abutting said locator means; and said coupler is crimped to said wall of said body to secure said body in said coupler and to effectuate a seal therebetween.

12. The venturi coupler of claim 8 wherein said locator means comprises radially inward indentations spaced about the periphery of said coupler.

13. The venturi coupler of claim 8 wherein said coupler also comprises a bellows section having a plurality of convolutions located between said pressure taps;

and said venturi body is received in at least one of said convolutions.

14. The venturi coupler of claim 13 wherein said venturi body has an annular rib about the periphery thereof and said rib is received in at least one convolution of said bellows.

15. The venturi coupler of claim 14 wherein said convolutions of said bellows and said rib of said venturi body have substantially the same pitch.

* * * * *